US009287601B2

(12) United States Patent
Yin et al.

(10) Patent No.: US 9,287,601 B2
(45) Date of Patent: Mar. 15, 2016

(54) PUBLIC CAVITY INPUT MULTIPLEXER

(75) Inventors: Xinshe Yin, Shaanxi (CN); Yafeng Xia, Shaanxi (CN); Mingnan Jiang, Shaanxi (CN)

(73) Assignee: XI'AN INSTITUTE OF SPACE RADIO TECHNOLOGY, Shaanxi (CN)

( * ) Notice: Subject to any disclaimer, the term of this patent is extended or adjusted under 35 U.S.C. 154(b) by 298 days.

(21) Appl. No.: 13/258,934

(22) PCT Filed: Jul. 1, 2009

(86) PCT No.: PCT/CN2009/072572

§ 371 (c)(1),
(2), (4) Date: Nov. 10, 2011

(87) PCT Pub. No.: WO2010/108345

PCT Pub. Date: Sep. 30, 2010

(65) Prior Publication Data

US 2012/0063471 A1 Mar. 15, 2012

(30) Foreign Application Priority Data

Mar. 25, 2009 (CN) ..... 2009 1 0080674

(51) Int. Cl.
*H01P 1/213* (2006.01)
*H01P 1/205* (2006.01)
*H01J 23/24* (2006.01)

(52) U.S. Cl.
CPC ..... *H01P 1/2136* (2013.01); *H01P 1/2053* (2013.01); *H01P 1/2138* (2013.01)

(58) Field of Classification Search
CPC ... H01P 1/2053; H01P 1/2136; H01P 1/2138; H01J 23/24; G02B 6/29394
See application file for complete search history.

(56) References Cited

U.S. PATENT DOCUMENTS 5,034,707 A * 7/1991 Kagstrom ..... 333/126
6,806,791 B1 * 10/2004 Wang et al. ..... 333/134

(Continued)

FOREIGN PATENT DOCUMENTS

CN 2113557 8/1992
CN 1500297 5/2004

(Continued)

OTHER PUBLICATIONS

Linear Technology Application Note 20—"Application Considerations for an Instrumentation Lowpass Filter" by Nello Sevastopoulos, published in Sep. 1986. Retrieved from http://cds.linear.com/docs/en/application-note/an20f.pdf.*

*Primary Examiner* — Xavier Szewai Wong
(74) *Attorney, Agent, or Firm* — Workman Nydegger

(57) ABSTRACT

The present invention relates to a public cavity input multiplexer that is used to divide broadband signals into multichannel narrowband signals according to the frequency and includes a public cavity and at least two channel filters. The public cavity is a broadband resonator that is used to input broadband signals, and is coupled with each of the channel filters respectively. In the input multiplexer of the present invention, no electric cable or waveguide and circulator are used for connection. The integrated design is achieved by establishing the public cavity and the channel filter, which reduces volume and mass, avoids the errors caused by influence on the circulator due to temperature change, enhances reliability, saves cost, and improves the electric performance. The design of the public cavity makes the input coupling accurate to calculate, convenient tuning and optimizes the consistency of channels.

16 Claims, 4 Drawing Sheets

(56) References Cited

U.S. PATENT DOCUMENTS

| | | | | |
|---|---|---|---|---|
| 7,068,128 | B1 * | 6/2006 | Macdonald et al. | 333/206 |
| 2002/0105394 | A1 * | 8/2002 | Barba Gea et al. | 333/202 |
| 2002/0110646 | A1 * | 8/2002 | Latouche et al. | 427/543 |
| 2003/0016709 | A1 * | 1/2003 | Flanders | 372/26 |
| 2004/0051602 | A1 * | 3/2004 | Pance et al. | 333/202 |
| 2007/0005308 | A1 * | 1/2007 | Lee et al. | 703/2 |
| 2007/0057747 | A1 * | 3/2007 | Kubo et al. | 333/134 |
| 2007/0110442 | A1 * | 5/2007 | Peer | 398/78 |
| 2007/0202920 | A1 * | 8/2007 | Eddy et al. | 455/562.1 |
| 2008/0133226 | A1 * | 6/2008 | Huang et al. | 704/219 |
| 2009/0045798 | A1 * | 2/2009 | Heah et al. | 324/76.19 |
| 2009/0081975 | A1 * | 3/2009 | Powell et al. | 455/188.2 |
| 2009/0136104 | A1 * | 5/2009 | Hajian et al. | 382/128 |
| 2009/0242248 | A1 * | 10/2009 | Sohn et al. | 174/258 |
| 2010/0013578 | A1 * | 1/2010 | Memarian | H01P 1/2086 333/219.1 |

FOREIGN PATENT DOCUMENTS

| | | |
|---|---|---|
| CN | 2814695 | 9/2006 |
| CN | 101533940 | 9/2009 |
| JP | 2007318220 | 12/2007 |

* cited by examiner

PUBLIC CAVITY INPUT MULTIPLEXER

CROSS-REFERENCE TO RELATED APPLICATIONS

This Patent Application is a U.S. National Stage of International Application No. PCT/CN2009/072572, filed on Jul. 1, 2009, which claims priority to Chinese Application No. CN 200910080674.6, filed on Mar. 25, 2009, the disclosures of which are incorporated herein by reference.

FIELD OF THE INVENTION

The present invention relates to a microwave input multiplexer device, especially a public cavity input multiplexer using a broadband resonator as the public cavity. The public cavity input multiplexer is used to divide broadband signals into multi-channel narrowband signals according to the frequency.

BACKGROUND OF THE INVENTION

With improvements in science and technology and market expansion, the satellite communication industry is developing rapidly. In the field of the satellite communication, the requirement for the reliability, the quality and the volume of aerospace products is very strict. High reliability and miniaturization are the developing trends for aerospace products. An input multiplexer is the communication satellite device indispensable to achieve the channelization of broadband signals. The existing input multiplexer utilizes electric cables or waveguide, circulator to connect channel filters, which causes such problems as big volume, heavy mass, low reliability and lack of consistency among channels.

SUMMARY OF THE INVENTION

In view of the defects or deficiency existing in the prior art, the purpose of the present invention is to provide a public cavity input multiplexer which is capable of dividing broadband signals into multi-channel narrowband signals according to the frequency, good for using integrated design of multi-channels, reducing volume and mass, and convenient to assemble and test, etc.

The technical solutions of the present invention are as follows: A public cavity input multiplexer, used to divide broadband signals into multi-channel narrowband signals according to the frequency, characterized in that: including a public cavity and at least two channel filters, the public cavity is a broadband resonator that is used to input broadband signals, and is coupled with each of the channel filters respectively.

The public cavity is coupled with a first resonator of each channel filter, and the first resonator is connected with an input port of the channel filter.

The public cavity is coupled with the first resonator of each channel filter through a coupling aperture, the coupling aperture is equipped with coupling screws, and the first resonator is connected with an input port of the channel filter. Selecting 2~8 channel filters.

The bottom surface of each of the channel filters is on the same plane.

Selecting 4 channel filters, side surfaces of each of the channel filters lay alongside of each other, after that the channel filters are arranged according to the 2*2 square matrix.

The input ports of each of the channel filters of are located on the top, the first resonators of each of the channel filters are laid alongside of each other.

The public cavity includes a public resonant post formed by two sections of metal posts connected, and the public resonant post is connected with a coaxial connector.

Resonators of each of the channel filters, arranged in a folding manner, have a pentagon-shaped resonant cavity inside. Each of the channel filters has an frequency-drift-with-temperature characteristic of −5.0~5.0 ppm/° C.

The resonator of each of the channel filters is a coaxial cavity resonator, and a resonant post of each of the channel filters is formed by joining together two types of materials having different coefficient of linear expansion.

The two types of materials having different coefficient of linear expansion are invar and aluminum, and a public resonant post of the public cavity is made of aluminum material.

Each of the channel filters is a channel filter that has a 10-order design, 4 limited-distance transmission zeros for enhancing out-of-band rejection and 4 group delay equalization zeros.

A bandwidth of the broadband resonance of the public cavity covers the center frequency of each channel filter.

Each of the channel filters is a coaxial cavity filter or a dielectric filter or a waveguide filter or a comb filter or an interdigital filter.

A center frequency of the resonance of each of the channel filters is 300 MHz~30 GHz.

The technical effects of the present invention are as follows:

A public cavity input multiplexer, used to divide broadband signals into multi-channel narrowband signals according to the frequency, includes a public cavity and at least two channel filters. The public cavity is a broadband resonator that is used to input broadband signals, and is coupled with each of the channel filters respectively. The input multiplexer of the present invention uses the public cavity in the input port. Broadband signals enter the public cavity which is a broadband resonator and coupled with each of the channel filters respectively, and broadband signals are therefore coupled with each of the channel filters. The input multiplexer of the present invention divides one-channel broadband signals into multi-channel narrowband signals according to different frequencies. The present invention has succeeded in achieving the integrated design of multi-channels by setting up the public cavity and the channel filters, without using electric cables or waveguides and circulators for connection. As a result, volume and mass can be reduced and errors caused by influence on the circulator due to temperature change can be eliminated, which accordingly enhances the reliability, saves the cost and improves electric performance. The design of the public cavity makes input coupling accurate to calculate, convenient tuning, and also makes channels possible to have excellent consistency.

The broadband signals in the public cavity are made coupled with each of the channel filters. As each of the channel filters all includes plural resonators, concerning each channel filter, the broadband signals in the public cavity can be coupled with one resonator or plural resonators. Coupling the public cavity with the first resonator of each of the channel filters and connecting the first resonator with the input port of the channel filter makes the design of the input multiplexer more convenient. The public cavity is coupled with the first resonator of each of the channel filters through the coupling aperture. As a result, the public cavity can couple the input broadband signals more directly with the resonators of each of the channel filters. The coupling aperture is equipped with coupling screws which are able to adjust accurately and quickly the coupling of the input end.

2~8 channel filters are selected and the bottom surface of each of the channel filters is placed on the same plane. In case where 4 channel filters are selected, the side surfaces of each of the channel filters are laid alongside of each other, and after that the channel filters are arranged according to the 2*2 square matrix. It is preferable that each of the channel filters share the same bottom surface and the neighboring two channel filters share the same side wall. In such case, the input ports of each of the channel filters are on the top, the first resonators of each of the channel filters are laid alongside of each other, and the public cavity is coupled with the first resonators of the channel filters. This "back to back, side by side" structure enables each of the channel filters to be connected structurally closely with each other and reduces volume and mass effectively.

The public cavity includes a public resonant post that is formed by connecting metal posts and the public resonant post is linked to the coaxial connector. The public cavity achieves the input coupling of broadband input signals through the public resonant post. The coaxial connector is linked to the public resonant post, convenient for assemblage.

The resonators of each of channel filters, arranged in a folding manner, have a pentagon-shaped resonant cavity inside. Structurally, the design of the pentagon-shaped resonant cavity is able to meet the requirement for the coupling variation of the main coupling and the cross coupling when the public cavity is coupled with the channel filters. This makes the coupling variation of the main coupling relatively bigger and that of the cross coupling relatively smaller. Besides, this also makes it more convenient to add certain cross couplings which do not exist in a coupling matrix. Therefore, a tuning is easy to be conducted.

Each of the channel filters can satisfy the frequency-drift-with-temperature characteristic of −5.0~5.0 ppm/° C. As a channel filter is a narrow band device, even a tiny size change resulted from temperature change will have a huge impact on electric performance. Therefore, temperature compensation technology should be utilized to eliminate the impact due to temperature change on the electric performance of the channel filter. The input multiplexer with a temperature compensation function is capable of preventing itself from frequency drift due to temperature which leads to a worse performance, enhancing the channel performance.

The resonators of each of the channel filters are coaxial cavity resonators. The resonant post of each of the channel filters is formed by joining together two types of materials having different coefficient of linear expansion, for example, invar and aluminum. The public resonant post of the public cavity is made of aluminum. The effect of temperature compensation in a certain range, for example −5.0~5.0 ppm/° C., can be achieved if the length of the resonant posts of each of the channel filters formed by two types of materials are accurately designed. Both the public cavity of the input multiplexer and the resonant cavity of the channel filter use aluminum material, which reduces mass. The coefficient of linear expansion of aluminum ($23\times10^{-6^0}$ $C^{-1}$), however, is large, and thus when temperature changes, metals expand, the resonator (including resonant cavity and resonant post) size of a channel filter has a crucial impact on resonant frequency. The coefficient of linear expansion of aluminum material is $23\times10^{-6^0}$ $C^{-1}$ and that of invar is $1.3\times10^{-6^0}$ $C^{-1}$. The outer conductor of the resonator (namely the resonant cavity of each of the channel filters) is aluminum. The inner conductor of the resonator (namely the resonant post of each of channel filters) is formed by joining these two materials together. The effect of zero-drift can be achieved if the proportion of the two types of materials is accurately calculated.

Each of the channel filters has 10-order design, 4 limited-distance transmission zero for enhancing out-of-band rejection and 4 group delay equalization zeros. The 10-order design makes out-of-band rejection and group delay variation more excellent and improves the whole channel performance.

DESCRIPTION OF THE PREFERRED EMBODIMENTS

Hereinafter, the present invention will be illustrated with reference to the drawings.

Figure 1:
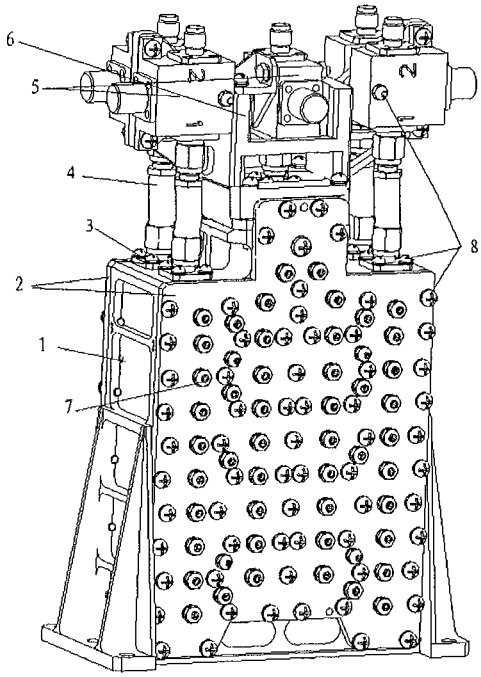
FIG. 1 shows a structure schematic diagram of a preferred embodiment of a public cavity input multiplexer of the present invention.
Figure 2:
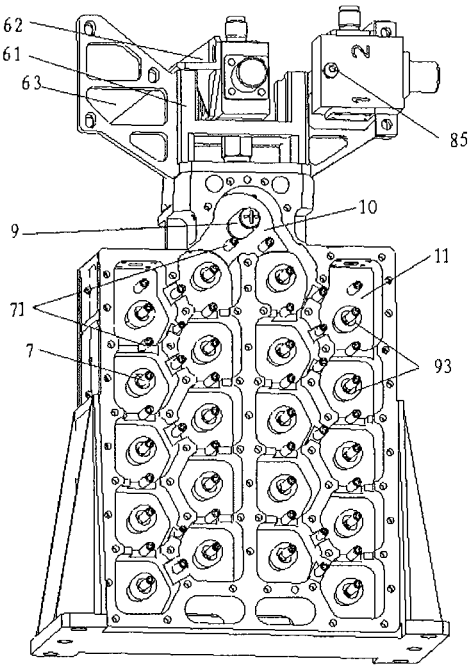
FIG. 2 shows a schematic diagram of the internal structure of a preferred embodiment of a public cavity input multiplexer of the present invention.
Figure 3A:
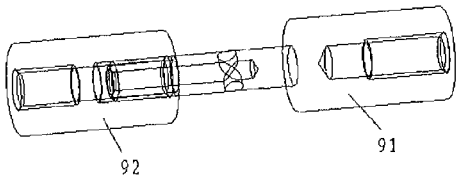
FIG. 3*a* shows a schematic diagram of a preferred public resonant post.
Figure 3B:
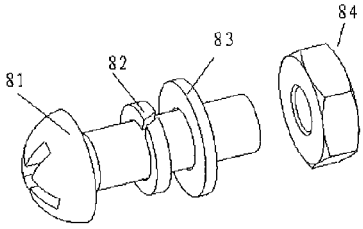
FIG. 3*b* shows a schematic diagram of the fastener used in the present invention.

A public cavity input multiplexer, used to divide broadband signals into multi-channel narrowband signals according to the frequency, includes a public cavity and at least two channel filters. The public cavity is a broadband resonator that is used to input broadband signals, and is coupled with each of the channel filters respectively. Each of the channel filters all includes plural resonators, and each resonator includes a resonant cavity and the corresponding resonant post inside the resonant cavity. The public cavity can be selected to couple with the first resonator of each channel filter. The first resonator is connected with the input port of the channel filter. The input multiplexer uses the public cavity for the input port. Broadband signals enter the public cavity and then are coupled with each of the channel filters through the first resonator of each channel filter. The input multiplexer having a public cavity structure can be formed by 2~8 channel filters via a public cavity. FIG. 1 and FIG. 2 show respectively a structure schematic diagram and an internal structure schematic diagram of a preferred embodiment of the public cavity input multiplexer of the present invention. In this embodiment, an input multiplexer formed by 4 channel filters via a public cavity was selected. This input multiplexer includes: a public cavity 10 and plural resonators 11 inside each of the channel filters, also includes a main cavity 1, a cover plate 2, a SMAKFD22 connector 3, a coaxial connector 4, an isolator 5, a holder 6, a tuning screw 7, a fastener 8 and a resonant post 93. Besides, the case surface of the input multiplexer is coated with thermal control paint, conductive adhesive and sealing glues, and the internal surface is silver-plated. In order to adjust the coupling of the input ends accurately and rapidly, a coupling screw 71 is set up on the coupling aperture between the public cavity 10 and the first resonator of each channel filter. In addition, a coupling screw 71 is also set up between the resonators of each channel filter. The assemblage is made vertically and the assembled area can be saved, which is very crucial to the payload of a communication satellite with a limited volume. Therein, the isolator 5 is divided into input-end isolator and output-end isolator. The holder 6 is divided into a main holder 61, a sub-holder 62 and a holder pad 63. FIG. 3*a* is a schematic diagram of a preferred public resonant post. The public cavity 10 includes a public resonant cavity and a public resonant post 9. The public resonant post 9 is formed by joining two metal posts together via screw thread, that is, a public resonant post 91 and a public resonant post 92. The public cavity achieves the input coupling of broadband input signals via the public resonant post. The public resonant post 9 is connected with the coaxial connector 4, convenient for assemblage. The fastener 8 is divided into a clamping screw 81, a spring pad 82, a flat pad 83, a clamping nut 84 and a clamping bolt 85. FIG. 3*b* shows a schematic diagram of the fasteners used in the present invention.

Figure 4:
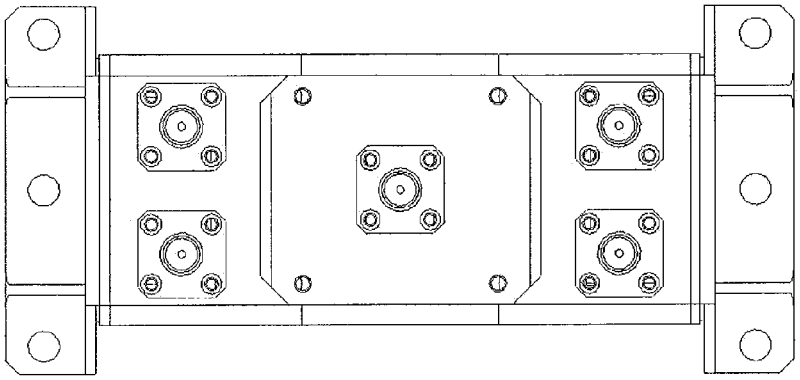
FIG. 4 shows a structure schematic diagram of the arrangement of 4 channel filters as a preferred embodiment of the present invention.
Figure 6:
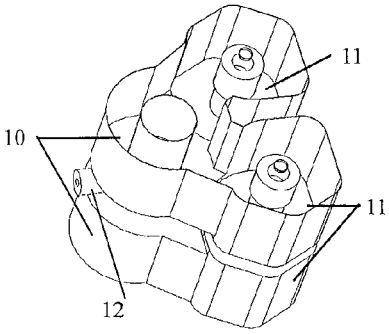
FIG. 6 shows a simulation structure diagram of a public cavity coupled with a channel filter.

FIG. 4 shows a structure schematic diagram of the arrangement of 4 channel filters as a preferred embodiment of the present invention. The 4 channel filters employ a "back to back, side by side" structure, that is, the 4 channel filters share the same bottom surface and the neighboring two channel filters share the same side wall. In such case, the public cavity 10 is coupled with the first resonators of each of channel filters, the input ports of each of the channel filters are on the top, and the first resonators of each of the channel filters are laid alongside of each other. FIG. 6 shows a simulation structure diagram of a public cavity coupled with a channel filter, wherein the input port 12 of broadband signals is placed in the public cavity. This "back to back, side by side" structure enables each of the channel filters to be connected structurally closely with each other and reduces volume and mass effectively. In terms of electric performance, the design of the public cavity makes the input coupling accurate to calculate and convenient tuning, replaces the circulator connection of the previous input multiplexer, reduces volume and mass, and also avoids the impact that the temperature change has on the circulators.

Figure 5:
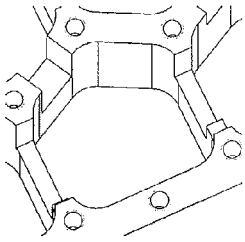
FIG. 5 shows a structure schematic diagram of the pentagonal resonant cavity of a channel filter

The resonators of each of the channel filters are arranged in a usual folding manner. The resonant cavity in the resonator is specially designed as a pentagon shape. FIG. 5 shows a structure schematic diagram of the pentagonal resonant cavity of a channel filter. This design can achieve conveniently the cross-coupling required by the folding manner. Structurally speaking, the pentagon-shaped design of a resonant cavity can meet perfectly the requirement for coupling variation of a main-coupling and a cross-coupling when the public cavity is coupled with the channel filters, which makes the coupling variation of a main coupling bigger and that of a cross-coupling smaller. Moreover, the pentagon-shaped design, being able to add conveniently certain cross couplings that do not exist in the coupling matrix, can be made directly by means of coupling aperture without demanding complicated coupling methods, which is easy to achieve, and convenient tuning.

Figure 7:
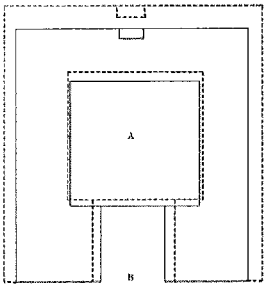
FIG. 7 shows a diagram showing the impact that temperature has on the size of the resonator of a channel filter.

Both the public cavity of the input multiplexer and the resonant cavity of the channel filter use aluminum material, which reduces mass effectively. The coefficient of linear expansion of aluminum ($23\times10^{-6}$ $C^{-1}$), however, is large, and thus metals expand when temperature changes, the resonator (including resonant cavity and resonant post) size of a channel filter has a crucial impact on resonant frequency. As a channel filter is a narrow band device, even the tiny size change caused by the temperature change can lead to significant impact on electric performance. Therefore, temperature compensation technology should be utilized to eliminate the impact due to temperature change on the electric performance of the channel filter (regarding a dielectric resonator, since a dielectric has an excellent performance in terms of temperature, it needs no temperature compensation technology). The resonators of each of the channel filters are coaxial cavity resonators, and the resonant posts of each of the channel filters are formed by joining two types of materials having different coefficients of linear expansion, invar A and aluminum B for example. The public resonant post of the public cavity uses aluminum. FIG. 7 shows a diagram showing the impact that temperature has on the size of the resonator of a channel filter. The temperature compensation in a −5.0~5.0 ppm/° C. temperature range and the effect of zero-drift can be achieved, if the proportion of the two types of materials and the length that form the resonant posts of each of the channel filters are accurately designed.

Figure 11:
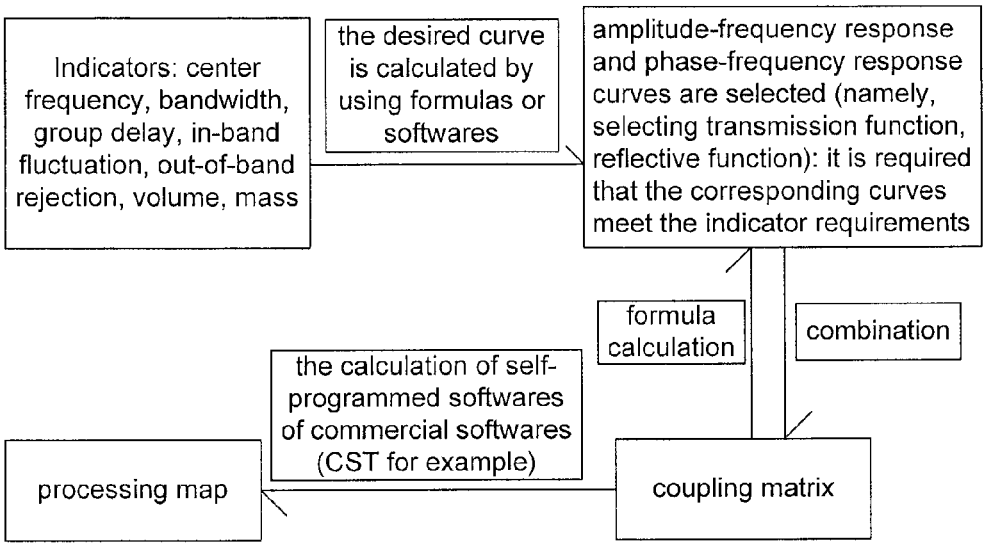
FIG. 11 shows a design flowchart of a channel filter.

FIG. 11 shows a design flow chart of a channel filter. A channel filter is an electromagnetic circuit wherein energy can pass by means of tuning under certain resonant frequency. Accordingly, a channel filter is widely used in the field of communication in order to achieve the energy transfer in a desired frequency band (namely pass-band) and suppress the energy transfer in the undesired frequency band (namely stop-band). In addition, a channel filter has some measuring indicators in order to meet the requirements. The typical indicators include: insertion loss (namely the in-band minimum loss), insertion loss fluctuation (namely the in-band flatness), suppression or isolation (namely the stop-band attenuation), group delay (namely an indicator concerning the phase performance of a channel filter) and reflection loss.

At first, design a channel filter according to the requirements of the indicators and take the single channel filter as an example. According to the center frequency and bandwidth, choose the suitable coupling resonator and suitable Q value for a channel filter.

A coupling resonator circuit is suitable for various physical structures such as waveguide, dielectric resonator, microstrip line, coaxial cavity. Different physical structures are suitable for different frequency ranges. For example, the center frequency of an indicator lies in C-band, because the volume of a waveguide resonator is big in C-band; a dielectric resonator is also a good choice, but the test volume must be bigger than a coaxial cavity; a microstrip line resonator has a low Q value, which can not meet the requirement of the present invention; a coaxial cavity resonator is easy to be tuned, and moreover the obtained Q value is kilo-order of magnitude, which exactly meet the requirement of the present invention. Therefore, the present invention selected the coaxial cavity filter formed by the coaxial cavity resonator.

Then, determine the amplitude-frequency response and phase-frequency response curves that meet the requirements of the indicators according to the required indicators such as insertion loss, stop-band attenuation, group delay, in-band flatness. The corresponding curves should meet the requirements of the indicators. The coupling matrix is obtained synthetically in accordance with the determined curves. The concrete physical size is obtained by calculating with self-programmed software or commercial software (CST for example) based on the obtained coupling matrix and then processing map is obtained through drawing.

The specific steps are as follows:

1. Determination of Amplitude-Frequency Response and Phase-Frequency Response

In order to satisfy the indicators for the channel filter mentioned above, normally it is necessary to design the amplitude-frequency response and phase-frequency response curves (the amplitude-frequency response curve means: the curve wherein signal amplitude changes along with frequency, which is for measuring the transfer or reflection of energy when frequency is different. Phase-frequency response curve means: the curve wherein signal phase changes along with frequency, which has impact on the quality of communication) for different channel filters. The transfer function ($S_{21}$, namely $S_{21}$ described in S parameter) and the reflective function ($S_{11}$, namely $S_{11}$ described in S parameter) are two important factors for the amplitude-frequency response of a channel filter, which can be defined by the polynomial illustrated in the following equations:

$$S_{11}(s) = \frac{F(s)}{E(s)}\ S_{21}(s) = \frac{P(s)}{\varepsilon E(s)}$$

Herein, F(s), P(s) and E(s) are polynomial of the variable s. s=jω, j=$\sqrt{-1}$, ω is angular frequency, ∈ is constant, ∈ is related to reflection loss. The root of the numerator polynomial F(s) is the reflection zero of a channel filter, the root of the numerator polynomial P(s) is the transmission zero of a channel filter, and the root of the denominator polynomial E(s) is the pole of a channel filter. By changing the number and position of reflection zero, transmission zero and pole, different types of channel filter response, such as Chebyshev, elliptic function, maximum flatness response and similar elliptic function etc, can be selected. By changing the number and position of reflection zero, transmission zero and transmission pole, the forms of the amplitude-frequency response and phase-frequency response curves can be changed. Different amplitude-frequency response and phase-frequency response curves meet the requirements of various kinds of indicators.

When choosing the number and position of reflection zero, transmission zero and transmission pole, they can all be calculated according to the formulas in terms of the filters using the following transmission forms: Chebyshev, elliptic function, maximum flatness response. However, in consideration of the factors that the limited-distance transmission zero can not be selected regarding Chebyshev function and maximum flatness response, and the pole position can not be changed at random regarding elliptic function, the present invention selected the similar elliptic function as the transmission form.

Concerning the similar elliptic function can be selected based on certain experiences or tests flexibly. According to a series of requirements such as Hurwitz polynomial, the similar elliptic function must satisfy certain function expressions such as: the choice of pole must be in the left half-plane of the complex plane; one pair or several pairs of the transmission zero must be pure imaginary numbers for providing out-of-band high rejection; when transmission zero is complex number, it used to improve group delay and in-band fluctuation, namely the so-called self-equalization technique.

Each of the channel filters adopts the channel filter characterized in 10-order design, 4 limited-distance transmission zero for enhancing out-of-band rejection and 4 group delay equalization zeros. That is to say, there are 4 cross couplings wherein two are used for achieving the out-of-band poles, and the other two are used for self-equalization in order to compensate the in-band group delay. The 10-order design makes out-of-band rejection and group delay change more excellent and improves the whole channel performance. The concrete choices are as follows:

Transmission zero: ±1.01j, ±1.6j, ±0.62±0.35j, ∈ is 0.05.

Pole: −0.02±1.03j, −0.097±0.97j, −0.23±0.75j, −0.25±0.45j, −0.26±0.16j.

Reflective zero: ±1.02j, −0.07±0.97j, −0.19±0.74j, −0.22±0.44j, −0.23±0.15j.

2. Coupling Matrix Deduction

First Step: Obtain the Known Expression of $y_{22}$ and $y_{21}$

It is already known:

$$S_{11}(s) = \frac{F(s)}{E(s)},\ S_{21}(s) = \frac{P(s)}{\varepsilon E(s)}$$

polynomial and ∈, wherein (s=jw).

Obtain two expressions of Admittance matrix $y_{22}(s)$, $y_{21}(s)$.

Outer impedance seen from the input end is $$Z_{11}(s) = \frac{z_{11}[1/y_{22}+1]}{z_{22}+1} \tag{1.1}$$

Wherein, both $z_{11}$ and $z_{22}$ are the impedances of two-port network itself.

The impedance is $$Z_{11}(s) = \frac{1+S_{11}(s)}{1-S_{11}(s)} = \frac{E(s)\pm F(s)}{E(s)\mp F(s)} = \frac{m_1+n_1}{m_2+n_2} \tag{1.2}$$

Wherein, $m_1+n_1$ is the numerator of $Z_{11}(s)$.

$$m_1 = Re(e_0+f_0)+Im(e_1+f_1)s+Re(e_2+f_2)s^2+\ldots$$

$$n_1 = Im(e_0+f_0)+Re(e_1+f_1)s+Im(e_2+f_2)s^2+\ldots \tag{1.3}$$

$m_1$ is the sum of the real part polynomial of the coefficient of the even power and the imaginary part polynomial of the coefficient of the odd power regarding s in E(s)+F(s).

$n_1$ is the sum of the imaginary part polynomial of the coefficient of the even power and the real part polynomial of the coefficient of the odd power regarding s in E(s)+F(s).

$m_2$ is the sum of the real part polynomial of the coefficient of the even power and the imaginary part polynomial of the coefficient of the odd power regarding s in E(s)−F(s).

$n_2$ is the sum of the imaginary part polynomial of the coefficient of the even power and the real part polynomial of the coefficient of the odd power regarding s in E(s)−F(s).

Regarding the case of two-port even order resonator:

$$Z_{11}(s) = \frac{n_1[m_1/n_1+1]}{m_2+n_2}$$

can be obtained by using $n_1$ in the formula 1.2, and thus it can be deduced that $$y_{22} = \frac{n_1}{m_1} \tag{1.4}$$

The conversion regarding the network matrix of a two-port network is as follows:

$$\begin{bmatrix} y_{11} & y_{12} \\ y_{21} & y_{22} \end{bmatrix} = \frac{\begin{bmatrix} 1 - S_{11} + S_{22} - |S| & -2S_{12} \\ -2S_{12} & 1 + S_{11} - S_{22} - |S| \end{bmatrix}}{1 + S_{11} + S_{22} + |S|}, \tag{1.5}$$

$|S|$ is determinant

As $y_{21}$ and $y_{22}$ share the same denominator, $y_{21}$ and $S_{21}(s)$ share the same transmission zero, $$y_{21} = \frac{P(s)}{\varepsilon m_1} \tag{1.6}$$

In case of two-port odd order resonator:

$$y_{22} = \frac{m_1}{n_1},\ y_{21} = \frac{P(s)}{\varepsilon n_1} \tag{1.7}$$

In case of single-port even order resonator:

$$y_{22} = \frac{n_1}{m_1},\ y_{21} = \frac{P(s)}{\varepsilon m_1} \tag{1.8}$$

In case of single-port odd order resonator:

$$y_{22} = \frac{m_1}{n_1},\ y_{21} = \frac{P(s)}{\varepsilon n_1} \tag{1.9}$$

In case of single-port network, in the formulas 1.8 and 1.9

$$m_1 = Re(e_0) + Im(e_1)s + Re(e_2)s^2 + \ldots,$$

$$n_1 = Im(e_0) + Re(e_1)s + Im(e_2)s^2 + \ldots \tag{1.10}$$

Wherein, $e_i$, $f_i$, (i=1, 2, . . . N) is the complex coefficient of E(s) and F(s).

The coefficients of the above-mentioned two polynomials are real and imaginary in alternative in order to ensure the existence of the root of pure imaginary numbers.

Second Step: Obtain the Unknown Expression of $y_{22}$ and $y_{21}$

Figure 10:
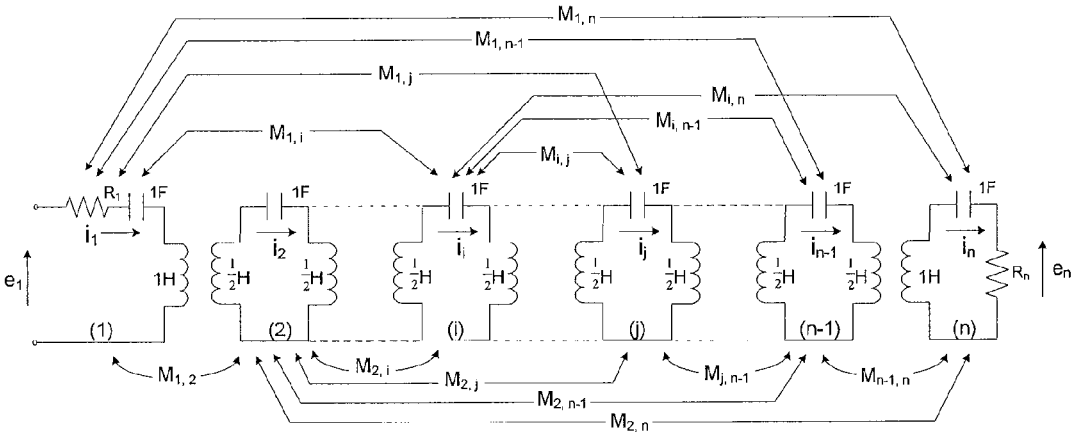
FIG. 10 shows an equivalent circuit diagram of an n-order channel filter.

FIG. 10 shows an equivalent circuit diagram of an n-order channel filter, and the circuit equation thereof is:

$$\begin{bmatrix} e_1 \\ 0 \\ 0 \\ 0 \\ \vdots \\ \vdots \\ \vdots \\ 0 \end{bmatrix} = \begin{bmatrix} S+R_1 & jM_{12} & jM_{13} & \ldots & \ldots & \ldots & \ldots & jM_{1n} \\ jM_{12} & S & jM_{23} & \ldots & \ldots & \ldots & \ldots & \ldots \\ jM_{13} & jM_{23} & S & \ldots & \ldots & \ldots & \ldots & \ldots \\ \vdots & \vdots & \vdots & \vdots & \vdots & \vdots & \vdots & \vdots \\ \vdots & \vdots & \vdots & \vdots & \vdots & \vdots & \vdots & \vdots \\ \vdots & \vdots & \vdots & \vdots & \vdots & \vdots & \vdots & \vdots \\ \vdots & \vdots & \vdots & \vdots & \vdots & \vdots & S & jM_{n-1,n} \\ jM_{1n} & \ldots & \ldots & \ldots & \ldots & \ldots & jM_{n-1,n} & S+R_n \end{bmatrix} \cdot \begin{bmatrix} i_1 \\ i_2 \\ i_3 \\ \vdots \\ \vdots \\ \vdots \\ i_{n-1} \\ i_n \end{bmatrix}$$

The matrix equation is:

$$E = Z \cdot i = j(\omega I - jR + M)i \tag{1.11}$$

Wherein, I is unit matrix; R is the matrix wherein the (1,1)th element is $R_1$, the (n,n)th element is $R_n$, and the remaining elements are zero;

M is the coupling matrix wherein all diagonal line elements are zero, and the remaining elements are $M_{ij}$ one by one.

Theoretical derivation is conducted to calculate $M_{ij}$.

Figure 12:
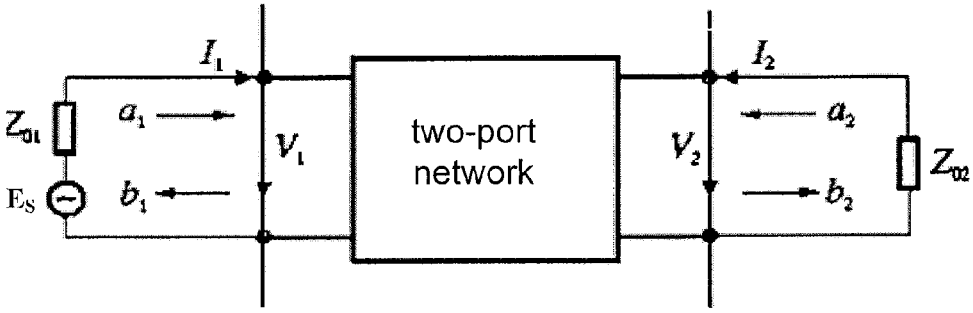
FIG. 12 is a schematic diagram of a two-port network.

The outer characteristics thereof is as illustrated in FIG. 12 that shows a schematic diagram of a two-port network, and the inner equivalent circuit diagram of a two-port network is as illustrated in FIG. 10, namely, an equivalent circuit diagram of an n-order channel filter.

$$I_1 = y_{11}V_1 + y_{21}V_2,$$

$$I_2 = y_{21}V_1 + y_{22}V_2 (y_{11} = y_{22}) \tag{1.12}$$

When $R_1 = R_n = 0$, $V_1 = e_1$, $V_2 = 0$, it can be known that short-circuit admittance is:

$$y_{11} = I_1/e_1 = i_1 = -j[(\omega I + M)^{-1}]_{11}, y_{21} = I_2/e_1 = i_n = -j[(\omega I + M)^{-1}]_{n1} \tag{1.13}$$

In the formula (1.11), make R equals zero, it can be obtained:

$$(\omega I + M)i = -j(1,0,0, \ldots, 0)' = e' \tag{1.14}$$

Wherein, $i = (i_1, i_2, \ldots i_n)$ is column matrix, wherein the mark "'" stands for inversion operator. Numerical value is $i_1 - y_{11}$, $i_n = y_{21}$. One orthogonal transformation of i i=Ty, TT'=I is put in the formula (1.14), both sides of equation left-multiply the formula i'=(Ty)' and the formula is changed to $$y'(T'MT + \omega I)y = y'T'e' \tag{1.15}$$

After T is applied to M, it becomes the diagonal matrix as below:

$$-T'MT = \Lambda = \begin{bmatrix} \lambda_1 & 0 & \ldots & 0 \\ 0 & \lambda_2 & \ldots & 0 \\ \vdots & \vdots & \ddots & \vdots \\ 0 & 0 & \ldots & \lambda_n \end{bmatrix} \tag{1.16}$$

Thus, M=−TΛT' can be deduced and put it in the formula (1.15):

$$y = -(\Lambda - \omega I)^{-1}T'e' \tag{1.17}$$

Also, there exists the following formula:

$$(\Lambda - \omega I)^{-1} = \begin{bmatrix} \frac{1}{\lambda_1 - \omega} & 0 & \ldots & 0 \\ 0 & \frac{1}{\lambda_2 - \omega} & \ldots & 0 \\ \vdots & \vdots & \ddots & \vdots \\ 0 & 0 & \ldots & \frac{1}{\lambda_n - \omega} \end{bmatrix} = D \tag{1.18}$$

It can be deduced that y=−DT'e'=−(DT')e', namely the formula:

$$i = \tag{1.19}$$

$$Ty = jTD(T_{11}, T_{12}, \ldots, T_{1n})' = jT\left(\frac{T_{11}}{\lambda_1 - \omega}, \frac{T_{12}}{\lambda_2 - \omega}, \ldots \frac{T_{1n}}{\lambda_n - \omega}\right)'$$

Therefore, the first element and the last element of the matrix i can be obtained.

$$i_1 = y_{11} = j\sum_{k=1}^{n}\frac{T_{1k}^2}{\lambda_k - \omega},\ i_n = y_{21} = j\sum_{k=1}^{n}\frac{T_{nk}T_{1k}}{\lambda_k - \omega} \tag{1.20}$$

Third Step: Obtain $\lambda_k$, $T_{1k}$, $T_{nk}$

It can be seen from the formula (1.20) that the characteristic value $\lambda_k$ of the matrix M is exactly the root of the denominator polynomial that $y_{22}$ and $y_{21}$ have in common. The elements in the first line and the last line of the orthogonal matrix T can be obtained according to $y_{22}$ and $y_{21}$ corresponding to the residue of each $\lambda_k$. Suppose that the residues of $y_{22}$ and $y_{21}$ are $r_{21k}$ and $r_{22k}$, and $$T_{nk} = \sqrt{r_{22k}},\ T_{1k} = \frac{r_{21k}}{T_{nk}} = \frac{r_{21k}}{\sqrt{r_{22k}}},\ k = 1, 2, \ldots, n \tag{1.21}$$

Fourth Step: Structure T, M Matrix:

When the first line and the nth line $T_{1k}$, $T_{nk}$ of the orthogonal matrix are obtained and the middle lines are used for unit matrix, the Smith orthonormalization is conducted to obtain T. The coupling matrix M can be deduced according to the formula (1.16).

$$\text{Also due to } R_1 = \sum_{k=1}^{n} T_{1k}^2,\ R_n = \sum_{k=1}^{n} T_{Nk}^2 \tag{1.22}$$

Finally, the coupling matrix obtained after synthesis and a folding arrangement rotation is $R_1$=0.1342, $R_n$=1.5839.

$$\begin{bmatrix}
0.0000 & 0.6938 & 0.0000 & 0.0000 & 0.0000 & 0.0000 & 0.0000 & 0.0000 & 0.0000 & 0.0142 \\
0.6938 & 0.0000 & 0.5528 & 0.0000 & 0.0000 & 0.0000 & 0.0000 & 0.0000 & -0.0197 & 0.0000 \\
0.0000 & 0.5528 & 0.0000 & 0.5016 & 0.0000 & 0.0000 & 0.0000 & 0.0906 & 0.0000 & 0.0000 \\
0.0000 & 0.0000 & 0.5016 & 0.0000 & 0.4928 & 0.0000 & -0.073 & 0.0000 & 0.0000 & 0.0000 \\
0.0000 & 0.0000 & 0.0000 & 0.4928 & 0.0000 & 0.6279 & 0.0000 & 0.0000 & 0.0000 & 0.0000 \\
0.0000 & 0.0000 & 0.0000 & 0.0000 & 0.6279 & 0.0000 & 0.5386 & 0.0000 & 0.0000 & 0.0000 \\
0.0000 & 0.0000 & 0.0000 & -0.073 & 0.0000 & 0.5386 & 0.0000 & 0.5602 & 0.0000 & 0.0000 \\
0.0000 & 0.0000 & 0.0906 & 0.0000 & 0.0000 & 0.0000 & 0.5602 & 0.0000 & 0.6476 & 0.0000 \\
0.0000 & -0.0197 & 0.0000 & 0.0000 & 0.0000 & 0.0000 & 0.0000 & 0.6476 & 0.0000 & 1.0640 \\
0.0142 & 0.0000 & 0.0000 & 0.0000 & 0.0000 & 0.0000 & 0.0000 & 0.0000 & 1.0640 & 0.0000
\end{bmatrix}$$

Wherein, $R_1$ is the coupling variation of the public cavity and the first resonator of the channel filter, namely the input coupling; $R_n$ is the coupling variation of the last resonator of the channel filter and output, namely output coupling. As illustrated in the coupling matrix, the coupling variation of the main coupling is relatively bigger and that of the cross coupling is relatively smaller. This pentagon-shaped design of the resonant cavity can meet this requirement structurally, and what is more, can make it convenient to add certain cross couplings that do not exist in the coupling matrix, which makes these couplings easy to be tuned.

3. Calculation of the Size of the Public Cavity 3.1 Calculation of the Resonant Frequency of a Single Cavity The resonant cavity of a channel filter is a metal cavity whose size is accurately designed. Normally, the neighbouring resonant cavities are connected by small gap (iris for example) to achieve the energy coupling between two resonators. Metal posts or ceramic dielectric materials can be used as the resonant cavity alternatively. It is clear to the person skilled in the art that the size of the resonator can be obtained according to analytic formula, numerical calculation.

After the material and the size of the resonator of a channel filter are determined, Q value (namely quality factor) of the channel filter is determined thereby. Regarding an actual filter, Q value will have direct impact on how big insertion loss and in-band flatness is. Specially, the filter with a high Q value has a small insertion loss, and has a steep roll-off in the transition zone (namely higher rectangular coefficient). On the contrary, the filter with a low Q value has a big energy loss due to big insertion loss, and the loss in the pass-band edge increases rapidly. For instance, the waveguide filter formed by the waveguide resonator with high Q value or the dielectric filter formed by the dielectric resonator has a Q value as high as from 8000 to 15000. The resonator with a low Q value, for example the coaxial cavity filter formed by the coaxial cavity resonator has a Q value from 2000 to 5000 magnitude.

Figure 8:
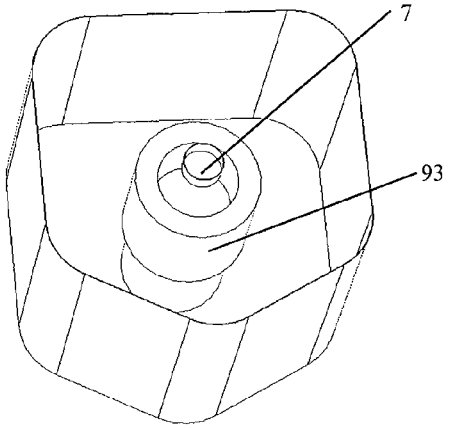
FIG. 8 shows a simulation structure diagram of the single resonator of a channel filter.

Normally, in order to increase Q value to improve the performance of a filter, it must select the resonator of big size, select suitable size of resonant cavity to meet the requirement of Q value. As illustrated in FIG. 8, a simulation structure diagram of the single resonator of a channel filter, the single cavity simulation model is established in the high-frequency simulation software CST in order to calculate the resonant frequency of single cavity. Selecting about 18 mm*18 mm*15 mm (height), about 2500 as Q value as the size of the cavity of the resonant cavity. When the length of the inner resonant post is 12.2 mm, the inner resonant post is 6 mm in diameter averagely. The center frequency is calculated to be 4.04 GHz.

Figure 9:
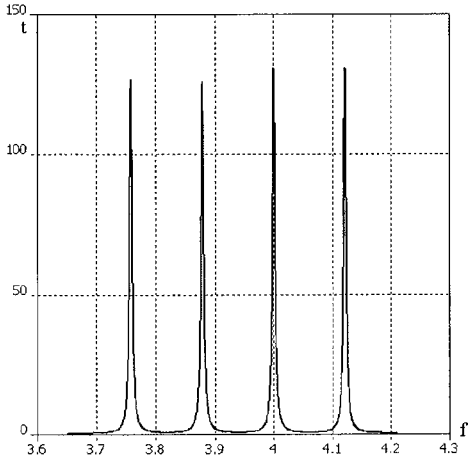
FIG. 9 shows a simulation curve of a public cavity.

When adjusting the length of the inner resonant post to different values, calculate the resonant frequency of 4 channels on the public cavity simulation curve as illustrated in FIG. 9, they are 3760 MHz, 3880 MHz, 4000 MHz, 4120 MHz.

3.2 Calculating the Input Coupling

According to the obtained coupling matrix, the input end of the input multiplexer is the public port of the public cavity, adopts the method of reflective group delay; modeling calculation is conducted in the high-frequency simulation software CST; make the public cavity broadband resonate by selecting properly the length and the diameter of the public cavity and the inner public resonant post. As the bandwidth of the public cavity broadband resonance needs to cover the center frequency of each channel filter, the bandwidth covers 3.7 GHz~4.2 GHz in this example to meet the requirements.

The coupling variation of the input end uses the reflective group delay to calculate:

The group delay of low pass filter S11 is defined as $$\Gamma_d(w) = -\frac{\partial\varphi}{\partial w}$$

Wherein, ϕ is the phase of S11 (unit rad), w is angular frequency. It will be $$\Gamma_d(w) = -\frac{\partial\varphi}{\partial w^1}\frac{\partial w^1}{\partial w}$$

when transformed to band pass filter.

$w^1$ is the angular frequency of low pass. Moreover, $$w^1 \to \frac{w_0}{w_2 - w_1}\left(\frac{w}{w_0} - \frac{w_0}{w}\right)$$

Wherein, $w_0$ is the center frequency of band pass filter, $w_1$ is the lower side frequency of the band pass and $w_2$ is the upper side frequency of the band pass.

$$w_0 = (w_1 w_2)^{1/2}$$

$$\Gamma_d(w) = -\frac{w^2 + w_0^2}{w^2(w_2 - w_1)}\frac{\partial\varphi}{\partial w^1}$$

The transmission function regarding the prototype of the low pass filter $$S_{11} = \frac{Z_{in} - Z_0}{Z_{in} + Z_0}$$

Wherein, $Z_{in}$ is the two-port network impedance seen from the port of the low pass filter, $Z_0$ is the source impedance.

In the lossless situation, $Z_{in}$ is a pure imaginary number, $Z_0$ is a real number.

$$S_{11} = \frac{jX_{in} - Z_0}{jX_{in} + Z_0}$$

Therefore, $$\varphi = -tan^{-1}\frac{X_{in}(w^1)}{Z_0} - tan^{-1}\frac{X_{in}(w^1)}{Z_0} = -2tan^{-1}\frac{X_{in}(w^1)}{Z_0}$$

$$X_{in} = -\frac{1}{w^1 g_1},\ Z_0 = g_0$$

Thus $$tan^{-1}\frac{X_{in}(w^1)}{Z_0} = tan^{-1} - \frac{1}{w^1 g_0 g_1}$$

$$\frac{\partial tan^{-1}\left(-\frac{1}{w^1 g_0 g_1}\right)}{\partial w^1} = \frac{g_0 g_1}{1 + (g_0 g_1 w^1)^2},$$

put it in the formula of the above group delay, what is obtained is $$\Gamma_d(w) = \frac{2(w^2 + w_0^2)g_0 g_1}{w^2(w_2 - w_1)\left(1 + (g_0 g_1)^2\left(\frac{w_0}{w_2 - w_1}\left(\frac{w}{w_0} - \frac{w_0}{w}\right)\right)^2\right)}$$

When $$w = w_0,\ \Gamma_{d1}(w_0) = \frac{4g_0 g_1}{w_2 - w_1} = \frac{4g_0 g_1}{2\pi(BW * R_1)},$$

wherein, $g_0$, $g_1$ are normalization factors of the low pass filter.

The obtained group delay value of resonance is 119 ns.

The simulation structure diagram of a public cavity coupled with a channel filter is as illustrated in FIG. 6 and the simulation curve of a public cavity is as illustrated in FIG. 9. According to the size calculated in the is above 3.1 section, change the size of the coupling aperture between the public cavity and the first resonator of the channel filter, change the length and diameter of the public resonant post, and obtain the desired value of group delay through calculation. In CST, the calculation value of group delay is 130 ns (the simulation value is 119 ns) when there is no tuning screw in the public cavity; the calculated length of the tuning screw is about 0.8 mm.

4. The Design of Coupling and Temperature Compensation

The modeling in CST is as illustrated in FIG. 8, the setting in CST is: the coefficient of linear expansion of invar is $1.3\times10^{-6^0}$ $C^{-1}$ and the coefficient of linear expansion of aluminum is $23\times10^{-6^0}$ $C^{-1}$. When calculating temperature compensation, the optional length of the structure is L. In case of aluminum material, when the temperature changes from 0 to T, the length changes from L to $L\times(1+T\times23\times10^{-6})$. The solver chooses to calculate the simulation result for eigenmode.

5. According to the requirements of the indicators, the size of each channel is calculated, the final calculated size is processed and tested, and the final input multiplexer can be obtained.

The main performance parameters and indicators of the present invention are illustrated in the following table 1:

TABLE 1

| parameters | | Indicator requirements |
|---|---|---|
| Center frequency | | 3760 MHz, 3880 MHz, 4000 MHz, 4120 MHz |
| bandwidth | | 36 MHz |
| Out-of-band rejection | Fc ± 22 MHz | ≥10 |
| | Fc ± 25 MHz | ≥22 |

TABLE 1-continued

| parameters | | Indicator requirements |
|---|---|---|
| (dBpp) | Fc ± 30 MHz | ≥35 |
| | Fc ± 50 MHz | ≥42 |
| Group delay (nspp) | Fc (center frequency points and in-band lowest points) | ≤3 |
| | Fc ± 10 MHz | ≤3 |
| | Fc ± 12 MHz | ≤4 |
| | Fc ± 14 MHz | ≤8 |
| | Fc ± 16 MHz | ≤25 |
| | Fc ± 18 MHz | ≤40 |
| Group delay slope (ns/MHz) | Fc ± 10 MHz | ≤0.8 |
| | Fc ± 12 MHz | ≤1.5 |
| | Fc ± 14 MHz | ≤3 |
| | Fc ± 16 MHz | ≤8 |
| | Fc ± 18 MHz | ≤25 |
| In-band insertion loss flatness (dBpp) | Fc ± 10 MHz | ≤0.3 |
| | Fc ± 12 MHz | ≤0.4 |
| | Fc ± 14 MHz | ≤0.5 |
| | Fc ± 16 MHz | ≤0.6 |
| | Fc ± 18 MHz | ≤0.8 |
| In-band insertion loss slope (dB/MHz) | Fc ± 12 MHz | ≤0.1 |
| | Fc ± 14 MHz | ≤0.2 |
| | Fc ± 16 MHz | ≤0.4 |
| | Fc ± 18 MHz | ≤0.6 |
| volume | | 60 mm * 120 mm * 200 mm |
| mass | | 1.3 Kg |
| reliability | | 20fits |

The design of the public cavity input multiplexer of the present invention can also be applied to the input multiplexer formed by the coaxial cavity filter, dielectric filter, waveguide filter, comb filter and interdigital filter whose center frequency is 300 MHz-30 GHz. No electric cable or waveguide and circulator are used for connection. The integrated design of multi-channels is achieved by establishing the public cavity and the channel filters, which reduces volume and mass, avoids the errors caused by influence on the circulator due to temperature change, enhances reliability, saves cost, and improves the electric performance. The design of the public cavity makes the input coupling accurate to calculate, convenient tuning and optimizes the consistency of channels. It should be noted that the above mentioned embodiments are aimed at enabling the person skilled in the art to understand the present invention more comprehensively, and should not be considered to limit this invention by any means. Therefore, although this specification has given a detailed description of the present invention with reference to the drawings and examples, it will be obvious to the person skilled in the art that the variations and equivalent replacements can be made to the present invention. In short, all technical solutions that do not depart from the spirit and scope of the present invention fall under the scope of protection for patent of the present invention.

The invention claimed is:

1. A public cavity input multiplexer, wherein the public cavity input multiplexer comprises: a public cavity and at least two channel filters that each include a respective resonant post, wherein the public cavity and the at least two channel filters cooperate to divide broadband signals into multi-channel narrowband signals according to a frequency, wherein the public cavity is a broadband resonator that is operable to input broadband signals, and the public cavity is coupled with each of the channel filters respectively using other than electric cables or waveguides for connection, and the public cavity is other than a multiple half-wavelength broadband resonator; the public cavity includes a public resonant post, and the public resonant post of the public cavity is parallel to the respective resonant posts of the channel filters.

2. The public cavity input multiplexer according to claim 1, wherein the public cavity is coupled with a first resonator of each channel filter, and the first resonator is connected with an input port of the channel filter.

3. The public cavity input multiplexer according to claim 1, wherein the public cavity is coupled with a first resonator of each channel filter through a coupling aperture, the coupling aperture is equipped with coupling screws, and the first resonator is connected with an input port of the channel filter.

4. The public cavity input multiplexer according to claim 3, wherein 2~8 channel filters are selected.

5. The public cavity input multiplexer according to claim 4, wherein the bottom surfaces of each of the channel filters are on the same plane.

6. The public cavity input multiplexer according to claim 5, wherein 4 channel filters are selected, side surfaces of each of the channel filters lay alongside of each other, after that the channel filters are arranged according to the 2*2 square matrix.

7. The public cavity input multiplexer according to claim 6, wherein the input ports of each of the channel filters are located on the top, the first resonators of each of the channel filters lay alongside of each other.

8. The public cavity input multiplexer according to claim 1, wherein the public resonant post is formed by two sections of metal posts connected, and the public resonant post is connected with a coaxial connector.

9. The public cavity input multiplexer according to claim 1, wherein resonators of each of the channel filters, arranged in a folding manner, have a pentagon-shaped resonant cavity inside.

10. The public cavity input multiplexer according to claim 1, wherein each of the channel filter of has an frequency-drift-with-temperature characteristic of −5.0~5.0 ppm/° C.

11. The public cavity input multiplexer according to claim 10, wherein the resonator of each of the channel filters is a coaxial cavity resonator, and a resonant post of each of the channel filters is formed by joining together two types of materials having different coefficient of linear expansion.

12. The public cavity input multiplexer according to claim 11, wherein the two types of materials having different coefficient of linear expansion are invar and aluminum, and a public resonant post of the public cavity is made of aluminum material.

13. The public cavity input multiplexer according to claim 1, wherein each of the channel filters is a channel filter that has a 10-order design, 4 limited-distance transmission zero for enhancing out-of-band rejection and 4 group delay equalization zeros.

14. The public cavity input multiplexer according to claim 1, wherein a bandwidth of the broadband resonance of the public cavity covers the center frequency of each channel filter.

15. The public cavity input multiplexer according to claim 1, wherein each of the channel filters is a coaxial cavity filter or a dielectric filter or a waveguide filter or a comb filter or an interdigital filter.

16. The public cavity input multiplexer according to claim 15, wherein a center frequency of each of the channel filters is 300 MHz~30 GHz.

* * * * *